US006363955B1

(12) United States Patent
Louie

(10) Patent No.: US 6,363,955 B1
(45) Date of Patent: Apr. 2, 2002

(54) SELF-DEPLOYING TUBULAR ENCLOSURE

(75) Inventor: Wai Hang Louie, Kowloon (HK)

(73) Assignee: Billwin Auto Accessories, Ltd., Chaiwan (HK)

( * ) Notice: Subject to any disclaimer, the term of this patent is extended or adjusted under 35 U.S.C. 154(b) by 0 days.

(21) Appl. No.: 09/480,463

(22) Filed: Jan. 10, 2000

(51) Int. Cl.[7] ..... E04H 15/40

(52) U.S. Cl. ..... 135/126; 135/128; 135/136; 135/137; 5/418

(58) Field of Search ..... 135/124, 125, 135/126, 127, 128, 130, 136, 134, 137, 148, 149, 905, 906; 5/415, 417, 418

(56) References Cited

U.S. PATENT DOCUMENTS

| | | | | |
|---|---|---|---|---|
| 3,534,750 A | * | 10/1970 | Kolozsvary | 135/906 X |
| 4,716,918 A | | 1/1988 | Hayashida et al. | 135/93 |
| 4,858,634 A | * | 8/1989 | McLeese | 135/126 |
| 5,031,652 A | | 7/1991 | Lester | 135/104 |
| 5,163,461 A | | 11/1992 | Ivanovich et al. | 135/104 |
| 5,337,772 A | | 8/1994 | Habchi | 135/104 |
| 5,385,165 A | | 1/1995 | Hazinski et al. | 135/126 |
| 5,601,105 A | | 2/1997 | Blen et al. | 135/126 |
| 5,676,168 A | * | 10/1997 | Price | 135/125 X |
| 5,800,067 A | * | 9/1998 | Easter | 135/126 X |
| 5,842,495 A | * | 12/1998 | Egnew et al. | 135/137 X |
| 6,109,281 A | * | 8/2000 | Lowenthal | 135/125 |
| 6,199,229 B1 | * | 3/2001 | Wong | 135/125 X |

FOREIGN PATENT DOCUMENTS

| | | | | |
|---|---|---|---|---|
| GB | 2224759 | * | 5/1990 | 135/125 |
| WO | WO90/15209 | * | 12/1990 | 135/125 |

* cited by examiner

*Primary Examiner*—Carl D. Friedman
*Assistant Examiner*—Winnie Yip
(74) *Attorney, Agent, or Firm*—Henri J. A. Charmasson; John D. Buchaca

(57) ABSTRACT

A self-deploying, collapsible and foldable fabric structure suitable for use as a shelter, shower stall or modesty screen in a changing room, comprises a base panel formed by a piece of fabric stretched over a flexible wire-looped frame. A series of additional flexible close wire-loop frames are mounted over the base panel at spaced-apart locations, and are covered with another piece of fabric to form a tubular enclosure.

18 Claims, 1 Drawing Sheet

SELF-DEPLOYING TUBULAR ENCLOSURE

FIELD OF THE INVENTION

This invention relates to tents and other light, temporary structures made of canvas stretched over foldable armatures.

BACKGROUND OF THE INVENTION

There is disclosed in the prior art, several types of collapsible and foldable tents and similar structures which use armatures made of wire loops that can be conveniently twisted and folded into compact shapes for easy storage and transport. When such a structure is made of several interconnected wire frames, it becomes very difficult to twist and fold the device into a compact shape. As disclosed in U.S. Pat. No. 5,163,461 Ivanovich et al., it has been found necessary to provide swiveling connections between the ends of the wire loops in order to facilitate the folding process. The instant invention results from an attempt to reduce the amount of panel and armature material as well as the number of wall components and fasteners in relatively large canvas structures, and to improve the structure foldability without use of complex connecting hardware, and without compromising their volume and stability.

SUMMARY OF THE INVENTION

The principal and secondary objects of this invention are to provide a simple, lightweight, stable, yet easily collapsible and pliable, large size tent structure in a completely unitary and fully integrated configuration that does not require any swiveling fasteners within wire loop components. These and other valuable objects are achieved by using only one wire loop and canvas panel to form the floor of the structure and one or more close loops attached to the canvas portion of the floor to support the fabric cover.

DESCRIPTION OF THE PREFERRED EMBODIMENT OF THE INVENTION

Figure 1:
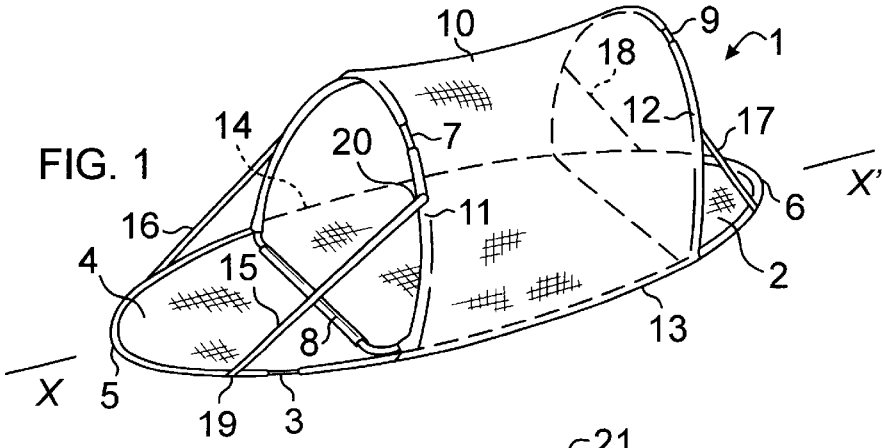
FIG. 1 is a perspective view of a fabric structure according to the invention.

Referring now to the drawing, there is shown in FIG. 1, a first preferred embodiment of the invention in the form of a tubular enclosure 1. The enclosure comprises a base panel 2 which is made of a flexible, wire-loop frame 3 of the type commonly used in the fabrication of self-erecting shelters as disclosed in U.S. Pat. No. 5,163,461 Ivanovich et al. which patent is hereby incorporated in this specification by this reference. It should be noted, however, that the above-mentioned wire loop frame and the additional ones mentioned below are of the close type, and do not include swiveling connectors which would allow one butt-end of the wire loop to rotate independently from the other abutting end. A piece 4 of fabric-like material such as canvas, or a woven or unwoven natural or synthetic fabric is stretched across and secured around its periphery to the wire-loop frame 3. The base panel 2 provides a flat surface lying in a horizontal plane, and typically resting upon the ground. Preferably, the base panel has an elliptical shape with opposite, longitudinal poles 5, 6 along a longitudinal axis X–X'. A first additional close wire-loop frame 7 lies in a plane that intersects the horizontal plane of the base panel, and in a direction perpendicular to the longitudinal axis X–x'. The additional wire-loop frame 7 is positioned apart from and between the two poles 5, 6 and is secured to the base panel by a stitched strip of fabric 8. A second additional wire-loop frame 9 is similarly mounted upon the base panel at a distance from the first additional loop 7. A second piece of fabric-like material 10 of a substantially rectangular shape has two opposite sides secured to the two additional loops 7, 9 respectively, and the other two opposite sides 13, 14 attached to opposite lateral portions of the base panel. Two pairs of straps 15, 16 and 17, 18 are used like guy wires to hold the additional wire loops 7, 9 in a raised position and keep the second piece 10 of fabric-like material taut between those two additional loops. Each strap has one lower end 19 attached to a peripheral section of the base panel, and an opposite upper end 20 attached to a median section of one of the additional wire frame loops. It should be understood that those two pairs of straps could be replaced by two guy wires or straps, each connected to the apex of one of the additional loops and one of the base panel poles 5 and 6. An additional piece of fabric-like material can be spread across one or both of the additional wire loop frames to form front and back walls with or without access apertures. Moreover, one of the additional loops can be omitted and the second piece of fabric-like material can be spread between the additional loop and the periphery of the base panel on either side of that additional loop frame.

Figure 2:
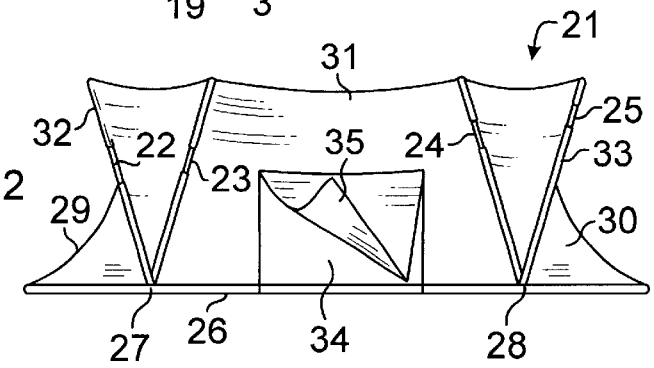
FIG. 2 is a side elevational view of a first alternate embodiment of the invention.

In the first alternate embodiment of the invention 21 illustrated in FIG. 2, two pairs of additional wire-loop frames 22, 23 and 24, 25 are used. In each pair, the two frames are attached to the base panel 26 at a common location 27, 28. Gussets 29, 30 each made of a triangular piece of pliable fabric-like material are used in lieu of the straps of the first embodiment to hold the front and back additional frames 22, 25. The second piece of fabric-like material 31 that forms the walls and roof of the structure is stretched all the way from those first and last additional loops, extending over the internal additional loops 23 and 24. Each wire-loop is secured to that second piece of fabric-like material by conventional means such as fabric loops or channels as practiced in the prior art. As in the first embodiment, end walls 32 and 33 can be attached across the outer frames 22 and 25. An access aperture 34 is practiced in the side of the structure, and provided with a sealable cover 35.

Figure 3:
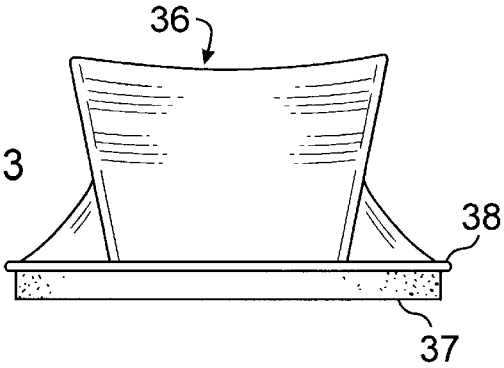
FIG. 3 is a side elevational view of a floating version of the invention.

In the second alternate embodiment of the invention 36 illustrated in FIG. 3, a slab 37 of synthetic close-cell foam or other buoyant material is bonded to the underside of the base panel 38 to create a floating structure.

Figure 4:
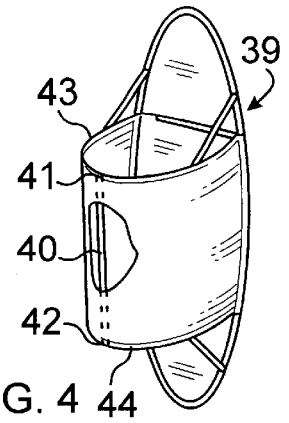
FIG. 4 is a perspective view of an embodiment of the invention used as a vertical, tubular enclosure.

A structure similar to the first embodiment of the invention 1 can be used as a vertical enclosure 39 as illustrated in FIG. 4. The enclosure can be suspended from a vertical post or a wall and can be used as a shower enclosure or modesty screen in the changing room of a department store. The wall of the structure can be further strengthened by having a resiliently flexible wire 40 spanning the apexes 41, 42 of the additional wire loops 43, 44.

Figure 5:
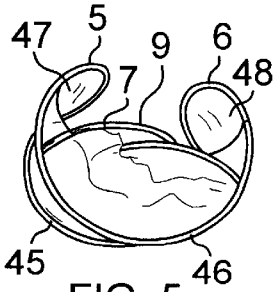
FIG. 5 is a perspective view of one of the embodiments of the invention in the process of being folded.
Figure 6:
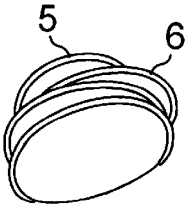
FIG. 6 is a perspective view of that embodiment in the final folded state.

The type of structure described above that can be folded in a very compact and flat configuration for easy storage or transportation. Grabbing the base plate near the longitudinal poles 5 and 6, the base plate is bent into a near circle wrapped around the additional loops 7 and 9. As shown in FIG. 5, the additional loops are forced one on top of the other. The median portions 45, 46 of the base panel wire loop frame are automatically brought together, and across each other as the folding process is continued by folding the longitudinal ends 47, 48 of the base panel over each other and against the additional loops 7 and 9. The whole structure turns into a pack of neat concentric loops as illustrated in FIG. 6.

Figure 7:
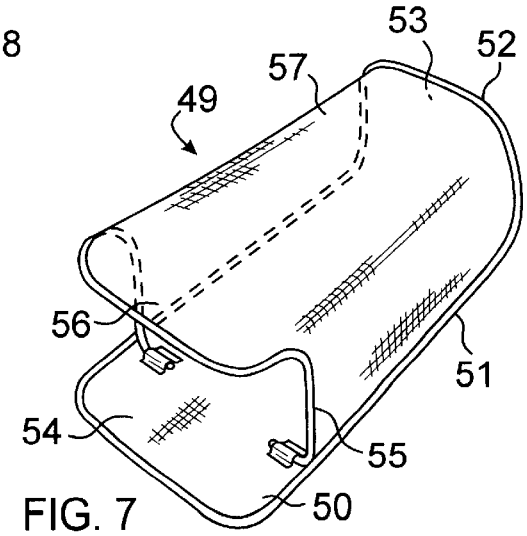
FIG. 7 is a perspective view of a second alternate embodiment of the invention.

In the alternate embodiment 49 of the invention illustrated in FIG. 7, the base panel 50 is delineated by a substantially rectangular closed wire-loop frame 51 having an end portion 52 bent upwardly to form an arch. The corresponding section 53 of the base panel fabric 54 forms a back or end wall. The additional wire frame 55 is not closed but is arched into three separate planes to form an overhang 56 over the structure entrance when the second fabric piece 57 is stretched across, and secured to the additional wire frame and the base panel 50.

While the preferred embodiments of the invention have been described, modifications can be made and other embodiments may be devised without departing from the spirit of the invention and the scope of the appended claims.

What is claimed is:

1. A self-deploying, collapsible and foldable enclosing structure which comprises:

a base panel including a first resiliently flexible, closed wire-loop frame having opposite first and second longitudinal poles and a longitudinal axis intersecting said poles, and a first piece of fabric material spread across and attached to said frame to form a flat surface lying in a first plane;

at least one additional resiliently flexible wire frame turned inwardly to form a linear bottom section substantially perpendicular to said axis and secured to the flat surface of the first piece of fabric material;

means for holding said additional frame in an orientation intersecting said first plane; and a second piece of fabric material secured to said base panel and additional frame.

2. The structure of claim 1 which comprises at least two of said additional frames.

3. The structure of claim 2, wherein said additional frames have portions secured to a common location on said base panel.

4. The structure of claim 3, wherein said additional frames are in separate fourth and fifth planes intersecting about said first plane.

5. The structure of claim 4, which comprises:

two spaced-apart pairs of said additional frames; and wherein said second piece of fabric-like material has opposite ends secured to opposite, lateral portions of said base panel, and a median area connected to said additional frames.

6. The structure of claim 2, wherein said additional frames have portions secured to said spaced apart locations on said base panel.

7. The structure of claim 6, wherein said additional frames are held in substantially parallel and spaced-apart second and third planes.

8. The structure of claim 7, which further comprises a flexible rod connected to each of said additional frames along a plane substantially perpendicular to said second and third planes.

9. The structure of claim 1, wherein said means for holding comprise at least one pliable strap secured at opposite ends to said base panel and additional frame respectively.

10. The structure of claim 1, wherein said means for holding comprise at least one pliable triangular gusset secured along a first side to said base panel and along a second side to said additional frame.

11. The structure of claim 1, which further includes a slab of buoyant material secured to said base panel.

12. The structure of claim 1, wherein said first closed wire-loop frame does not include any swiveling butt-end connectors.

13. The structure of claim 1, wherein said additional wire frame defines an arcuate shape.

14. The structure of claim 1, wherein said additional wire frame defines an open loop.

15. The structure of claim 1, wherein said base panel is substantially rectangular.

16. The structure of claim 1, wherein said additional frame comprises a single closed loop.

17. The structure of claim 1, which further comprises a means for securing a portion of said bottom section of at least one of said additional frames to section of said base panel spaced apart from either one of said first and second poles.

18. The structure of claim 17, wherein said means for securing comprises a strip of fabric stitched to the base panel.

* * * * *